US010119237B2

(12) United States Patent
Vasey

(10) Patent No.: US 10,119,237 B2
(45) Date of Patent: Nov. 6, 2018

(54) SELF-BORING ANCHORING DEVICE AND METHOD OF INSTALLING SUCH AN ANCHORING DEVICE

(71) Applicant: RAPTOR ANCHORING LIMITED, Tyne and Wear (GB)

(72) Inventor: Alan Gerard Vasey, Tyne and Wear (GB)

(73) Assignee: RAPTOR ANCHORING LIMITED, Tyne and Wear (GB)

( * ) Notice: Subject to any disclaimer, the term of this patent is extended or adjusted under 35 U.S.C. 154(b) by 0 days.

(21) Appl. No.: 15/533,094

(22) PCT Filed: Dec. 11, 2015

(86) PCT No.: PCT/GB2015/053856

§ 371 (c)(1),
(2) Date: Jun. 5, 2017

(87) PCT Pub. No.: WO2016/092322

PCT Pub. Date: Jun. 16, 2016

(65) Prior Publication Data

US 2017/0335537 A1 Nov. 23, 2017

(30) Foreign Application Priority Data

Dec. 12, 2014 (GB) ..... 1422193.1

(51) Int. Cl.
*B63B 21/26* (2006.01)
*E21D 21/00* (2006.01)
(Continued)

(52) U.S. Cl.
CPC ..... *E02D 5/801* (2013.01); *B63B 21/26* (2013.01); *E02D 5/22* (2013.01); *E21D 21/00* (2013.01); *E21D 21/008* (2013.01)

(58) Field of Classification Search
CPC ... B63B 21/26; E21D 21/0033; E21D 21/008; E02D 5/54; E02D 5/80; E02D 5/803
(Continued)

(56) References Cited

U.S. PATENT DOCUMENTS 2,667,037 A * 1/1954 Thomas ..... E21D 20/021 156/94
4,312,289 A * 1/1982 Conrad ..... B63B 21/26 114/295

(Continued)

FOREIGN PATENT DOCUMENTS

CN 202544883 U 11/2012
GB 2513942 A 11/2014
WO WO 1997/014609 A1 4/1997

OTHER PUBLICATIONS

International Searching Authority, International Search Report and Written Opinion for International Application No. PCT/GB2015/053856, dated Mar. 22, 2016, 10 pages, European Patent Office, Netherlands.

(Continued)

*Primary Examiner* — Frederick L Lagman
(74) *Attorney, Agent, or Firm* — Alston & Bird LLP

(57) ABSTRACT

Provided is a fixation device having a shaft rotatable about a longitudinal axis with a first cutter at a first, distal end; a guide body on the shaft shaped to taper outwardly towards the first end of the shaft; an elongate sleeve disposed surroundingly about the shaft; and a flareable end formation at a first, distal end of the elongate sleeve. The guide body and the flareable end formation urge the sleeve towards the first end over the guide body and flare the end formation outward from the shaft. A tensioning mechanism forms part of the fixation device and is associated with a second end of the sleeve and operable selectively to urge the shaft relative to the sleeve back towards the second end. An associated (Continued)

method of installing a fixation device into a substrate is also described.

25 Claims, 10 Drawing Sheets

(51) Int. Cl.
*E02D 5/80* (2006.01)
*E02D 5/22* (2006.01)

(58) Field of Classification Search
USPC ..... 405/259.1, 259.4, 244; 52/162, 163; 114/295, 301, 304, 307
See application file for complete search history.

(56) References Cited

U.S. PATENT DOCUMENTS 4,576,521 A * 3/1986 Conrad ..... B63B 21/26 114/293
4,592,178 A * 6/1986 Lu ..... E02D 5/803 405/248
4,882,891 A * 11/1989 Sero ..... E02D 5/72 405/229
4,974,997 A * 12/1990 Sero ..... E02D 5/72 405/231
5,150,549 A * 9/1992 Chen ..... E02D 5/76 52/155
5,152,649 A * 10/1992 Popp ..... B25B 31/00 29/256
5,161,916 A * 11/1992 White ..... E21D 21/008 405/259.4
5,460,231 A * 10/1995 Collins ..... E02D 5/80 175/258
6,223,671 B1 * 5/2001 Head ..... B63B 21/243 114/230.2
7,465,128 B2 * 12/2008 Bruneau ..... E21D 21/0026 405/259.1

OTHER PUBLICATIONS

The International Bureau of WIPO, International Preliminary Report on Patentability (Chapter I) for International Application No. PCT/GB2015/053856, dated Jun. 22, 2017, 8 pages, Switzerland.

* cited by examiner

SELF-BORING ANCHORING DEVICE AND METHOD OF INSTALLING SUCH AN ANCHORING DEVICE

CROSS REFERENCE TO RELATED APPLICATIONS

This application is a National Stage Application, filed under 35 U.S.C. 371, of International Application No. PCT/GB2015/053856, filed Dec. 11, 2015, which claims priority to United Kingdom Application No. 1422193.1, filed Dec. 12, 2014; the contents of both of which are hereby incorporated by reference in their entirety.

BACKGROUND

Related Field

This invention relates to a fixation device. In particular the invention relates to a fixation device that serves as both an anchor and pile in that it is adapted when in situ to resit both tensile and compressive loads. The invention is in particular a self boring anchor and pile for fixing a structure to a substrate such as the ground surface and for example a submerged structure to the subsea ground surface or sea bed. The invention also relates to a method of installing a fixation device in accordance with the present invention into a medium such as the ground surface and for example the subsea ground surface or sea bed to fix a structure and for example a submerged structure therein in stable manner such as to resit both tensile and compressive loads.

Description of Related Art

In marine applications in particular it may be desirable to anchor submerged structures. It is known to anchor, for example, a tidal power machine, to the seabed using a self-boring anchor. Embodiments of a suitable anchor are described in GB2513942. The embodiments comprise a first shaft or anchor stem having a first cutter comprising a drill head and bit at its distal end. A mandrel with a frustoconical outer surface seats on the shaft towards its distal end just behind the drill head. A sleeve or outer casing has articulated fingers at its distal end with second cutters on the tips of the fingers and is selectively slideable relative to the shaft so that the articulated fingers are selectively movable over the mandrel and flare outwardly as the sleeve moves towards the distal end.

A hole is made in the substrate, which in the case of subsea operations is the sea bed, by rotating the shaft or anchor stem to effect a cutting action via the first cutter and drive the shaft distally. Next, the sleeve is driven distally into a substrate around the anchor stem by rotating the sleeve to effect a cutting action via the second cutters. The mandrel on the shaft or anchor stem is tapered to flare outwardly towards the distal end of the shaft. When the fingers of the sleeve reach and pass over the mandrel, they are urged laterally so as to make an undercut in the substrate. The fingers prevent the anchor from being withdrawn from the hole when it is subjected to a tensile load.

In many applications, and for example in marine applications where an anchor is used to hold a submerged structure, an anchor may be subjected to variable load conditions as the anchored structure moves in the environment and at times to both tensile and compressive loads. Anchors such as are described in GB2513942 are effective in withstanding a load in tension but less effective in withstanding a load in compression.

BRIEF SUMMARY

In accordance with the invention in a first aspect a fixation device comprises a shaft rotatable about a longitudinal axis with a first cutter at a first, distal end;

a guide body on the shaft shaped to taper outwardly towards the first end of the shaft;

an elongate sleeve disposed surroundingly about the shaft to be rotatable separately from the shaft and translatable in a longitudinal direction relative to the shaft;

a flareable end formation at a first, distal end of the elongate sleeve comprising one or more second cutters;

the guide body and flareable end formation being arranged so that urging the sleeve towards the first end over the guide body flares the end formation outward from the shaft;

a tensioning mechanism associated with a second end of the sleeve operable selectively to urge the shaft relative to the sleeve back towards the second end.

In accordance with the invention the fixation device comprises a generally similar arrangement at a first, distal end, intended to be driven into the substrate such as the ground surface, as is described in GB2513942 and similar prior art. The first, distal end is initially driven into the substrate in familiar manner. The invention is characterised by the provision of a tensioning mechanism at a second end of the shaft operable selectively to urge the shaft relative to the sleeve back towards a second end, which in use is the end proximal to the substrate surface, and by means of which an improved ability to resist compressive loads can be conferred to the shaft and sleeve assembly in situ. In particular the outer sleeve is better able to resist compressive loads.

Thus, the arrangement at the first end provides a combination drill bit and self drilling anchor that is adapted to cut a hole comprising an undercut into a substrate.

In typical envisaged operation in a first phase of deployment of the fixation mechanism a guide hole is drilled into the substrate, which in the case of subsea operations is the sea bed, by rotatably driving the shaft about its longitudinal axis to effect a cutting action via the first cutter and drive the first end of the shaft distally into the substrate. The first cutter is for example a first cutting tip located at a distal tip of the shaft, for example conformed as a drill bit at the distal tip of the shaft.

Then, in a second phase of deployment of the fixation mechanism, the flareable end portion of the sleeve is caused to move over the guide body positioned towards the distal end of the shaft behind the first cutter, the sleeve is rotatably driven about the shaft, effecting a cutting action via the second cutters and causing the sleeve to be driven distally relative to the shaft. The guide body on the shaft is tapered to flare outwardly towards the distal end of the shaft. When the flareable end portion of the sleeve reaches and passes over the guide body, it is urged outwardly. This enables the second cutters to make an undercut in the substrate. The flareable end portion thus serves initially as a cutting head for cutting of this undercut. Typically the undercut comprises a reverse taper cut into the substrate from the hole, wherein the angle of the taper corresponds to the angle of the guide body surface. The flareable end portion then engages this undercut to prevent the anchor from being withdrawn from the hole when it is subjected to a tensile or pulling load. The flareable end portion thus serves additionally as an anchor being retained within the undercut to anchor the fixation device within the substrate.

Finally, in a third phase of deployment of the fixation device, the tensioning mechanism is operable at a second end of the sleeve to urge the shaft relative to the sleeve back towards a second end, being the end proximal to the substrate surface. This will generally tend to cause the flareable end portion to flare out yet further and as the flareable end portion reactively engages the undercut and resists the urging force applied by the tensioning mechanism will cause a tensile load to be generated in the shaft in situ. This selectively applied pre-tensioning allows the shaft to be set up in situ to resist compressive loadings as well as tensile loadings, and enables the fixation device to fix a structure stably in the complex and variable load scenarios such as might be encountered when the fixation device is used to fix a submerged structure to the sea bed.

References herein to a first or distal or lower end or end portion of the shaft, sleeve or fixation device will be understood to be references to the end or end portion that is driven first into a substrate in use and that is secured in the undercut hole in situ. References herein to a second or proximal or upper end or end portion of the shaft, sleeve or fixation device will be understood to be references to the end or end portion that seats uppermost in use at in the vicinity of the substrate surface. However the skilled person will understand that such references to the relative juxtaposition of components by intended use or intended location in situ are for convenience only. The invention is not thereby to be considered limited to the fixation device in use or deployed in situ expect where expressly so stated.

The invention is distinctly characterised by the provision of a tensioning mechanism at a second end of the shaft operable selectively to urge the shaft relative to the sleeve back towards a second end proximal to the substrate surface once the fixation device is in situ in a substrate with the flareable end portion deployed in flared conformance as an anchor in the substrate in the manner above described. The resistance of this urging force by the flareable end portion at the distal end allows a pre-tension to be applied to the shaft by means of which an improved ability to resist compressive loads can be conferred.

In this way the tensioning mechanism is configured co-operably with the flareable end portion at the distal end such that in use with the flareable end portion deployed in flared conformance as an anchor in a substrate below a substrate surface the selective operation of the tensioning mechanism at a second end of the shaft acting to urge the shaft relative to the sleeve back towards the substrate surface and the resistance of this urging force by the flareable end portion at the distal end co-operably effect a pre-tension in the shaft.

The tensioning mechanism associated with the second end of the sleeve is operable to urge the shaft relative to the sleeve back towards a second end of the sleeve. The urging mechanism thus acts to tend to translate second, proximal end of the shaft relative to the sleeve longitudinally back towards the second end of the sleeve. This tends to generate the pre-tension. The desired pre-tension may then be held by holding the relative juxtaposition of the second, proximal end of the shaft and the sleeve.

The tensioning mechanism is thus preferably further configured to lock the shaft in a fixed mechanical relationship and for example in a fixed relative translation juxtaposition to the second end of the sleeve when a desired pre-tension has been introduced. The tensioning mechanism is in particular preferably further configured to lock the shaft in a selective one of a plurality of fixed mechanical relationships and for example fixed relative translation juxtapositions, and more preferably a continuous range of the same, to allow a selectively variable desired pre-tension to be introduced. The tensioning mechanism thus preferably further comprises a locking mechanism to lock the relative positions of the second end of the sleeve and the shaft when a desired pre-tension has been introduced and thus at a selected relatively translated juxtaposition. Preferably the locking mechanism is adapted to lock the relative positions of the second end of the sleeve and the shaft in a plurality of locked positions and/or over a range of relatively translated juxtapositions to allow a selectively variable desired pre-tension to be introduced.

The tensioning mechanism is preferably in direct mechanical association with the second end of the sleeve. For example the tensioning mechanism is located at or towards the second end of the sleeve. For example the tensioning mechanism is in fixed mechanical relationship to the second end of the sleeve.

The invention is not limited by particular conformance of tensioning mechanism. The tensioning mechanism is arranged to apply an urging force to the shaft to tend to urge the shaft in a proximal direction relative to the proximal second end of the sleeve and back out of the drilled hole. This is resisted by the deployed distal flareable end portion of the sleeve to generate the pre-tension.

Suitable tensioning mechanisms include arrangements where a projecting proximal end portion of the shaft is arranged to project beyond a proximal end of the sleeve, for example through an aperture in the said proximal end, and a shaft engagement system is arranged to engage the projecting end portion and apply a tensioning force to the same by urging the end portion in a direction beyond the proximal end of the sleeve and for example outwardly of the aperture.

Suitable tensioning mechanisms include threaded formations. For example a threaded portion on the shaft engages with a complementary threaded formation provided in mechanical association with the second end of the sleeve. A suitable complementary threaded formation is a tensioning nut. For example the tensioning nut engages upon a top bearing surface or cap of the second end of the sleeve. Tightening of the tensioning nut tends to draw the shaft towards the second end of the fixation device. The anchor at the distal end of the sleeve created by the flared end portion of the sleeve as it is seated in the reverse tapered undercut reacts to this and a pre-tension is generated in the shaft as desired. The shaft is then held in fixed relationship with the second end of the sleeve to maintain this pre-tension in situ.

To maintain the shaft in tension, at least an upper portion of the sleeve at or about the second end must similarly be held stably in situ relative to the substrate to react to the pre-tension in the shaft. Accordingly an upper portion of the sleeve at or about the second end may be adapted by provision of a suitable reaction formation having one or more reaction surfaces adapted to engage with the substrate and for example adapted to engage with one, other or both of a surface of the substrate or the upper part of a hole when the fixation device is in situ within the said hole, whereby in use in situ at least the upper portion of the sleeve is held stably relative to the substrate surface and for example stably in the hole.

In a possible embodiment, a reaction formation may comprise an upper anchoring structure in direct mechanical association with an upper portion of the sleeve at or about the second end.

In a possible embodiment, a reaction formation may comprise a surface securing arrangement comprising a formation in direct mechanical association with an upper portion of the sleeve at or about the second end configured to be secured on or at the substrate surface. For example the surface securing arrangement may include a reaction surface disposed to seat upon the substrate surface in use. The surface securing arrangement is preferably attached to the sleeve at its proximal end.

The surface securing arrangement may also have a so-called "pile cap" or "top hat" attachment comprising a laterally extending plate-like member and a cylindrical member. There are cutters on the open edge of the cylindrical member. Driving the collar also drives the pile cap attachment such that the pile cap attachment cutters drill into the substrate at the same time as the first and second cutters at the distal end drill into the substrate. The cylindrical member extends distally into the annular groove that is cut. The pile cap attachment also takes compressive loads. In addition, the pile cap arrangement resists lateral loads imposed on the anchor. By extending distally into the substrate, the pile cap attachment assists in enabling the surface securing arrangement to withstand compressive loads. It also enables it to resist lateral loads. Moreover, the pile cap attachment may act as a platform or base on which a structure may stand.

Additionally or alternatively, in a possible embodiment, a reaction formation may comprise an upper anchoring structure configured integrally as part of the upper portion of the sleeve towards the second end as is for example a tapered formation of the sleeve towards the second end. In this embodiment the sleeve is configured to taper outwardly towards the second end. This is a reverse taper to that defined by the flareable end portion in the undercut at the distal end. Thus, in this embodiment, there is a taper at either end of the drilled hole in situ, and a formation at either end that engages with the taper to allow the desired pre-tension to be applied to the shaft. The proximal first end of the sleeve is thus urged and tensioned into the substrate.

In a particularly preferred embodiment the tapered formation of the sleeve comprises one or more third cutters disposed on an outer surface. Thus, as the sleeve is driven into the substrate in use, the third cutters define a tapered hole, for example at the same time as the second cutters drill the undercut, into which the tapered formation of the sleeve will engage as a tension is applied to the shaft via actuation of the tightening mechanism.

Suitable third cutters include one or more bladed formations on an outer surface of the tapered formation, and for example one or more axially progressive and for example helical blades.

The tapered formation of the sleeve is for example a frustoconical formation.

The tapered formation for example defines a taper angle of 1 to 10 degrees.

The fixation device preferably has an inner collar which screws onto the upper portion of the sleeve. A drive may be attached to the collar using a bayonet fixing.

A particular point of distinction can be noted over prior art anchors such as GB2513942. In the present invention, a mechanism is provided by means of which a pre-tension can be applied to the shaft, such that the fixation device can resist both tensile and compressive load scenarios. At least the upper portion of the sleeve is an integral part of the configuration by means of which this pre-tension is stabilised, since it carries the tightening mechanism and seats in or at the surface to react to this pre-tension load. By contrast, in GB2513942 the sleeve is merely envisaged as a means to torque couple and drive the flareable end portion over the mandrel to create the tapered undercut after which it is suggested that the major part of the sleeve can be withdrawn altogether.

In a particularly advantageous embodiment, adapted to facilitate the introduction of a desired pre-tension in situ into the shaft by actuation of the tensioning mechanism, the sleeve is provided in at least two parts comprising a distal part and a proximal part, the two parts being axially spaced by a torque coupling by means of which they are co-rotatable as the sleeve is driven into the ground, but which coupling is adapted to allow relative translation of the two parts to reduce their axial spacing as an axial load is applied. Thus, the sleeve is in effect collapsible as the pre-tensioning force is applied to the shaft by the tensioning mechanism.

Conveniently, the distal part and proximal part are axially spaced by a frangible torque coupling, that is, by a torque coupling that is configured to fail at a predetermined axial loading as the pre-tensioning force is applied to the shaft by the tensioning mechanism.

A suitable frangible torque coupling comprises mutually engageable projecting torque surfaces at a distal end of the proximal part and a proximal end of the distal part engaged together by one or more frangible connectors such as one or more shear pins.

Conveniently, the torque surfaces comprise mutually engageable inner and outer tubular portions. Conveniently, the torque surfaces comprise mutually engageable internally and externally splined formations, for example internally and externally splined compression tubes.

The torque surfaces are co-operably configured to engage with each other and couple the rotation of the parts of the sleeve in the first and second phases of deployment. In the third phase, as the pre-tensioning force is applied to the shaft by the tensioning mechanism, the frangible connectors are configured to fail to allow relative translation of the two parts to reduce their axial spacing. The projecting torque surfaces may facilitate this by being configured to telescope one within the other and/or by being compressible for example.

The sleeve thus functions as a single mechanically coupled means to transmit torque to the second cutters during the initial deployment, but collapses to facilitate application of the pre-tensioning force during the third phase of deployment.

Where the sleeve comprises at least two parts, including a distal part and a proximal part, the proximal part is conveniently adapted to include a reaction formation as above described. In particular the proximal part comprises an upper anchoring structure configured integrally as part of the proximal part of the sleeve towards the second end as is for example a tapered formation of the proximal part of the sleeve. This is a reverse taper to that defined by the flareable end portion in the undercut at the distal end. Thus, in this embodiment, there is a taper at either end of the drilled hole in situ, and a formation at either end that engages with the taper to allow the desired pre-tension to be applied to the shaft and sleeve assembly in situ.

In this embodiment the distal part of the sleeve may comprise a simple right circular cylinder.

As discussed in more detail above, deployment of a device in accordance with the first aspect of the invention will typically have three phases: the drilling of an initial guide hole using the first cutter at the tip of the shaft; the drilling of the undercut hole and simultaneous deployment of the anchor in the undercut hole (the flared portion of the sleeve performing both roles); and the application of a desired pre-tension to the shaft in situ.

It is the third phase in particular that characterises the invention over GB2513942 and similar prior art, with the fixation device being adapted at least by the provision of a means to apply a tensile load to the shaft in situ in the form of a suitable tensioning mechanism, and preferably further by a means to hold the upper portion of the sleeve stably at or about the substrate surface and resist the tensile load which is in the preferred case a second tapered formation, and preferably further by making the sleeve collapsible as an axial load is applied to the shaft. The first and second phases are broadly similar to those envisaged by the prior art, and features of those prior art self-boring anchors will be understood to be applicable to the invention by analogy.

The shaft is rotatable about a longitudinal axis and comprises a first cutter at a first, distal end to drill into the substrate during the first phase of deployment.

The first cutter is for example a first cutting tip located at a distal tip of the shaft, for example conformed as a drill bit at the distal tip of the shaft. The first cutting tip preferably comprises a drill head and drill bit.

The shaft preferably comprises a shaft drive coupling for applying torque to the shaft for driving the first cutter. The shaft drive coupling is for example a bayonet drive coupling.

The sleeve includes a flareable end formation at a first, distal end with one or more second cutters disposed on an outer surface and for example on an outer end surface of the end formation.

The sleeve preferably comprises a sleeve drive coupling for applying torque to the sleeve for driving the second cutters. The sleeve drive coupling is for example a bayonet drive coupling.

The shaft drive coupling and the sleeve drive coupling comprise respective means for engaging a suitable rotary drive to independently rotate and drive the shaft and sleeve about and in a direction parallel to the longitudinal axis of the fixation device.

The first cutter and second cutters may comprise may comprise any known type of cutter, depending on the medium being drilled, such as a diamond impregnated cutter, a tungsten cutter, hardened steel cutter or a polycrystalline diamond cutter (PCD), for example.

A first cutter may comprise a cutting formation located at a distalmost tip of a drill bit mounted in association with a distal end of the shaft.

A second cutter may comprise a cutting formation located on a distal end face of the flareable end portion of the sleeve. Additionally or alternatively a second cutter may comprise a cutting formation located on an outer circumferential surface of the flareable end portion of the sleeve.

The shaft is elongate and mounted to be rotatable about a shaft longitudinal axis. The sleeve is elongate and mounted to be rotatable separately about a sleeve longitudinal axis. The sleeve is disposed surroundingly about the shaft. Conveniently the sleeve and shaft are coaxially mounted with a common longitudinal axis. The sleeve is for example of hollow circular cross-section for example comprising either cylindrical or frustoconical flared sleeve portions, with the shaft receivingly mounted coaxially in the centre.

The guide body on the shaft is shaped to taper outwardly towards the first end of the shaft. This causes the flareable end formation at a first, distal end of the elongate sleeve to be deployed outwardly as the sleeve is urged towards the first end. The guide body conveniently comprises a frustoconical body.

The guide body may be formed integrally with or attached to the shaft. In a possible embodiment the guide body may be separately formed from the shaft and is for example mounted to be rotatable about the shaft but has axial movement along the shaft restricted. For example the guide body has an axial channel with an inner bearing surface and is journalled onto the shaft to rotate about the inner bearing surface. Preferably a stop prevents axial movement of the guide body along the shaft. Preferably a stop restricts lateral movement of the guide body and the drill bit at least to prevent the drill bit from moving laterally through the guide body.

The guide body is positioned towards the distal end of the fixation device, in the vicinity of and behind the first cutter. The guide body may include the first cutter for example as a cutting tip. The guide body may additionally comprise or be integrally formed with a drill head for a drill bit constituting the first cutter.

The flareable end formation at a first, distal end of the elongate sleeve is configured to deploy over the guide body, thereby both drilling an undercut hole with a reverse taper and anchoring the fixation device within the hole so drilled.

In a possible embodiment a flareable part of the sleeve comprises a pivot arranged to allow the flareable part of the sleeve to bend about the pivot as it is flared outward by the guide body surface.

In a particularly convenient embodiment the flareable part of the sleeve comprises a plurality of pivotable fingers disposed to be deployable outwardly as the flareable part of the sleeve is flared outward by the guide body surface. That is, each finger is articulated to a lower body portion of the sleeve by means of a pivoting connection. Conveniently such a plurality of pivotable fingers comprises an array of evenly spaced fingers, for example being evenly circumferentially arrayed on a lower surface of a lower body portion of the sleeve. Conveniently such fingers are identical. Conveniently each such finger carries one or more second cutters, for example at an end surface of the finger distal of the pivoting connection, or additionally or alternatively on an outer surface of the finger.

In a possible embodiment the shaft may be hollow. Suitably the shaft may comprise a central bore. The central bore may be adapted for use as a flushing channel to flush the drill face during drilling. A return channel is preferably defined by the external surface of the sleeve. Suitably the shaft may comprise one or more flushing grooves and/or ports to prevent a build up of removed material during cutting.

Although the invention is not seen as requiring the anchor to be grouted in many instances, the central bore may be adapted for use as a path for grout to flow if required. The grout will flow through the device and into the hole to provide additional strength to the fixation device. The shaft may comprise one or more holes along its length which communicate with the bore to provide further grout flow paths.

In a further aspect of the invention a method of installing a fixation device into a substrate, the fixation device comprising a shaft rotatable about a longitudinal axis having a first cutter at a first, distal end; a guide body on the shaft shaped to taper outwardly towards the first end of the shaft; and an elongate sleeve disposed surroundingly about the shaft to be rotatable separately from the shaft and translatable in a longitudinal direction relative to the shaft having a flareable end formation at a first, distal end of the elongate sleeve comprising one or more second cutters; the method comprising:

rotating the shaft and thereby boring a hole into a substrate using the first cutter;

translating the sleeve in a longitudinal direction distally relative to the shaft to urge the flareable end formation over the guide body and flare the end formation outward from the shaft;

rotating the sleeve and thereby reaming out an undercut in the substrate; urging the shaft relative to the sleeve back towards the second end of the sleeve to apply a tension to the shaft.

The second aspect of the invention is thus in particular preferably a method of deployment of the fixation device of the first aspect, and preferred features of the method will be understood by analogy of the discussion hereinabove of such deployment.

In particular, the method preferably comprises three phases of deployment, in that: in a first phase of deployment the shaft is rotatably driven about its longitudinal axis to effect a cutting action via the first cutter and drive the first end of the shaft distally into the substrate;

in a second phase of deployment the flareable end portion of the sleeve is caused to move over the guide body positioned towards the distal end of the shaft behind the first cutter, such that when the flareable end portion of the sleeve reaches and passes over the guide body it is urged outwardly, the sleeve is rotatably driven about the shaft, effecting a cutting action via the second cutters and causing the sleeve to be driven distally relative to the shaft to make an undercut in the substrate;

in a third phase of deployment a pre-tension is applied to the shaft by urging the shaft relative to the sleeve back towards a second end of the device, being the end proximal to the substrate surface, whereby a tensile load is applied the shaft in situ.

Typically the undercut comprises a reverse taper cut into the substrate from the hole, wherein the angle of the taper corresponds to the angle of the guide body surface. The flareable end portion then engages this undercut to prevent the anchor from being withdrawn from the hole when it is subjected to a tensile load.

The invention is distinctly characterised in that a pre-tension is applied to the shaft and sleeve assembly in situ by means of which an improved ability to resist compressive loads can be conferred. In particular the outer sleeve is better able to resist compressive loads. This is effected for example by actuation of a tensioning mechanism as above described.

In a preferred case the method comprises the further step of locking the relative positions of the second end of the sleeve and the shaft when a desired pre-tension has been introduced.

In a possible embodiment a projecting proximal end portion of the shaft is arranged to project beyond a proximal end of the sleeve, for example through an aperture in the said proximal end, and the step of urging the shaft relative to the sleeve back towards the second end to apply a tension to the shaft comprises applying an urging force to the projecting proximal end portion.

In a possible embodiment threaded portion on the shaft engages with a complementary threaded formation provided in mechanical association with the second end of the sleeve and the step of applying a tension to the shaft comprises tightening the thread.

In a possible embodiment at least an upper portion of the sleeve at or about the second end is provided with a suitable reaction formation having one or more reaction surfaces adapted to engage with the upper part of a hole in situ. For example the upper portion of the sleeve towards the second end comprises a tapered formation whereby the sleeve is configured to taper outwardly towards the second end.

Most preferably the tapered formation of the sleeve comprises one or more third cutters disposed on an outer surface and the step of translating the sleeve in a longitudinal direction distally relative to the shaft for example in the second phase of deployment includes driving this tapered formation into the substrate surface to form a complementarily tapered hole.

In a particularly advantageous embodiment, the sleeve is provided in at least two parts comprising a distal part and a proximal part axially spaced apart, the two parts are co-rotated as the sleeve is translated laterally and for example driven into the substrate during the second phase of deployment, and the two parts are then caused to move axially closer together as the shaft is urged relative to the sleeve back towards the second end of the sleeve to apply a tension to the shaft whereby an axial load is applied during the third phase of deployment.

Conveniently this is effected in that the two parts are axially spaced by a frangible torque coupling as above described, and the axial load is applied during the third phase of deployment to break this coupling.

The method is particularly preferably applied to the securing into position of a buoyant subsurface apparatus to a bed of a body of water.

BRIEF DESCRIPTION OF THE FIGURES

The invention will now be described by way of example only with reference to the accompanying drawings in which.

DETAILED DESCRIPTION OF VARIOUS EMBODIMENTS

Figure 1:
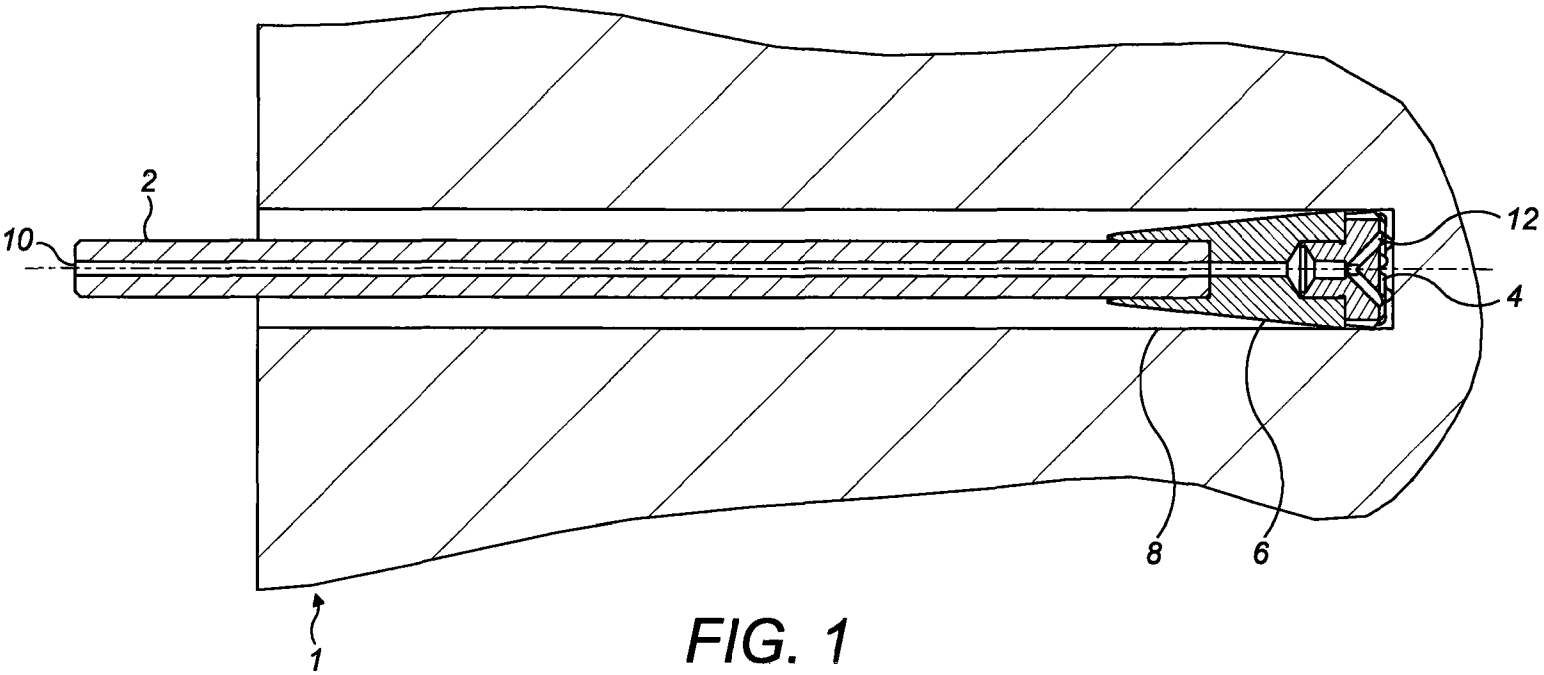
FIGS. 1 to 6 illustrate in cross-section at various stages of deployment into a ground substrate a first embodiment of fixation device in accordance with the principles of the invention.
Figure 2:
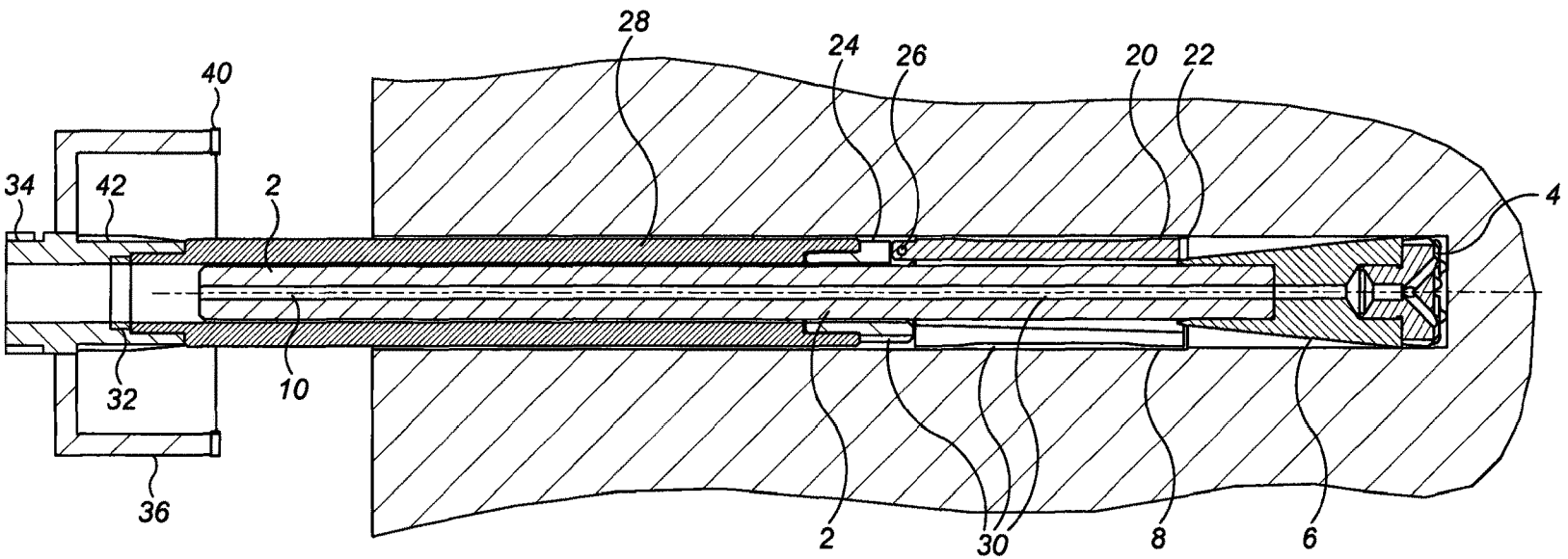
Figure 3:
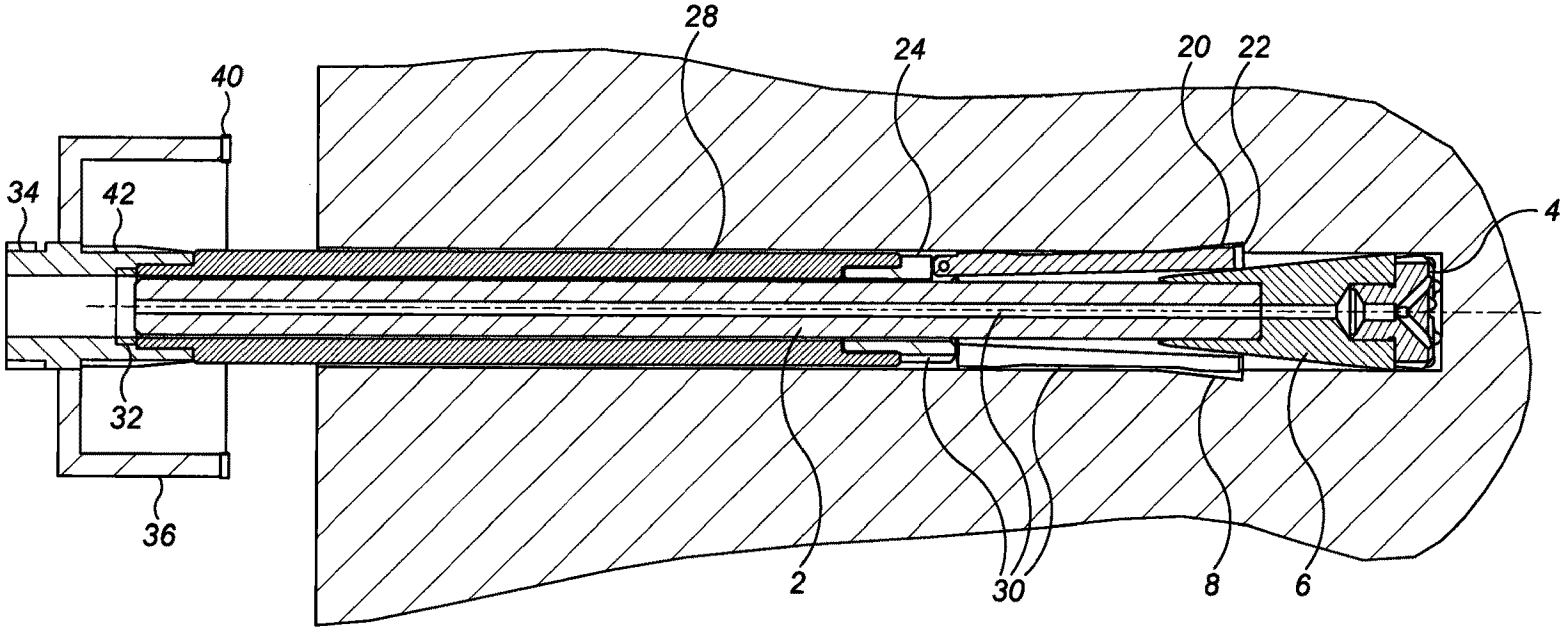
Figure 4:
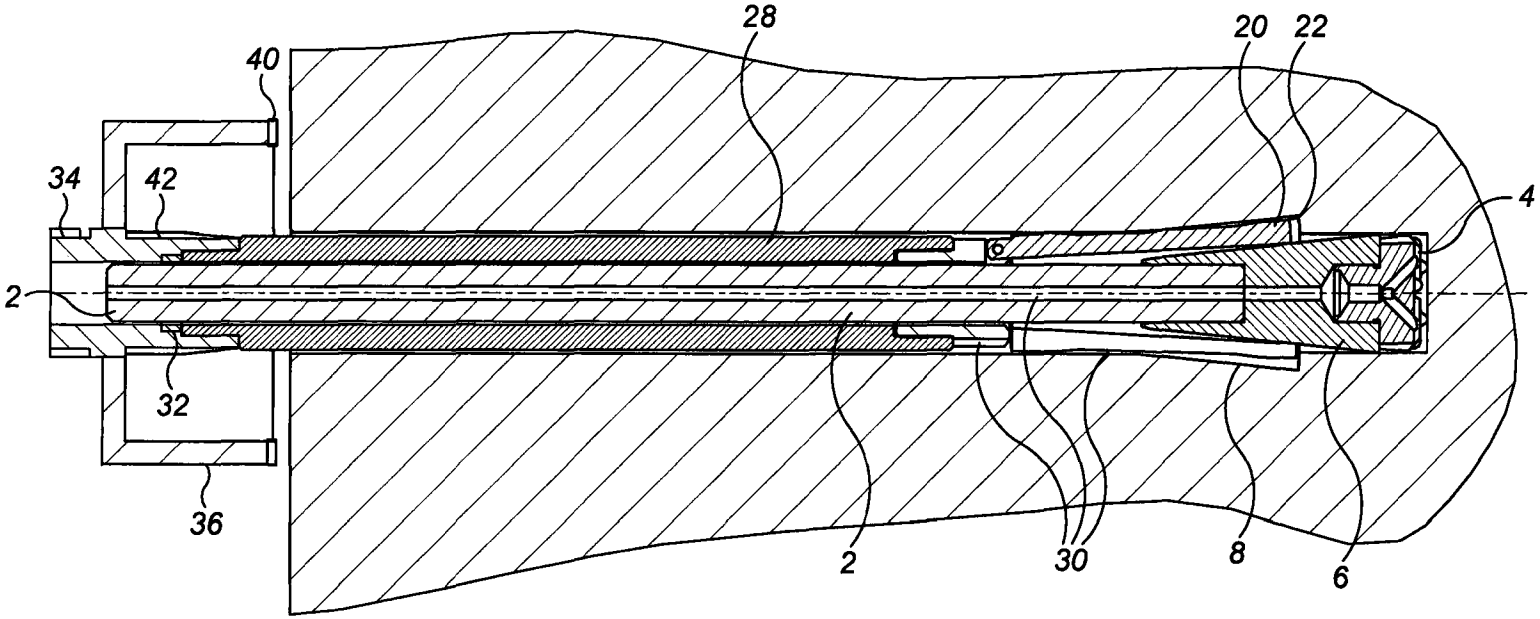
Figure 5:
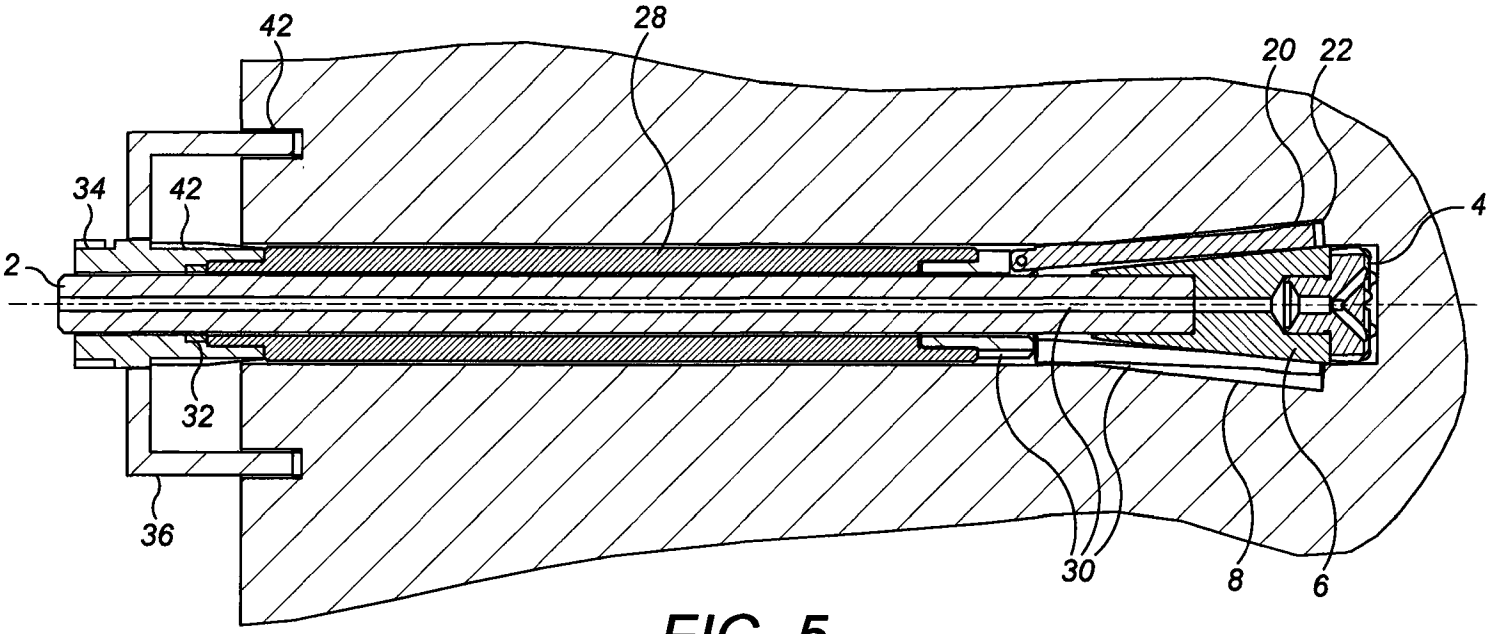
Figure 6:
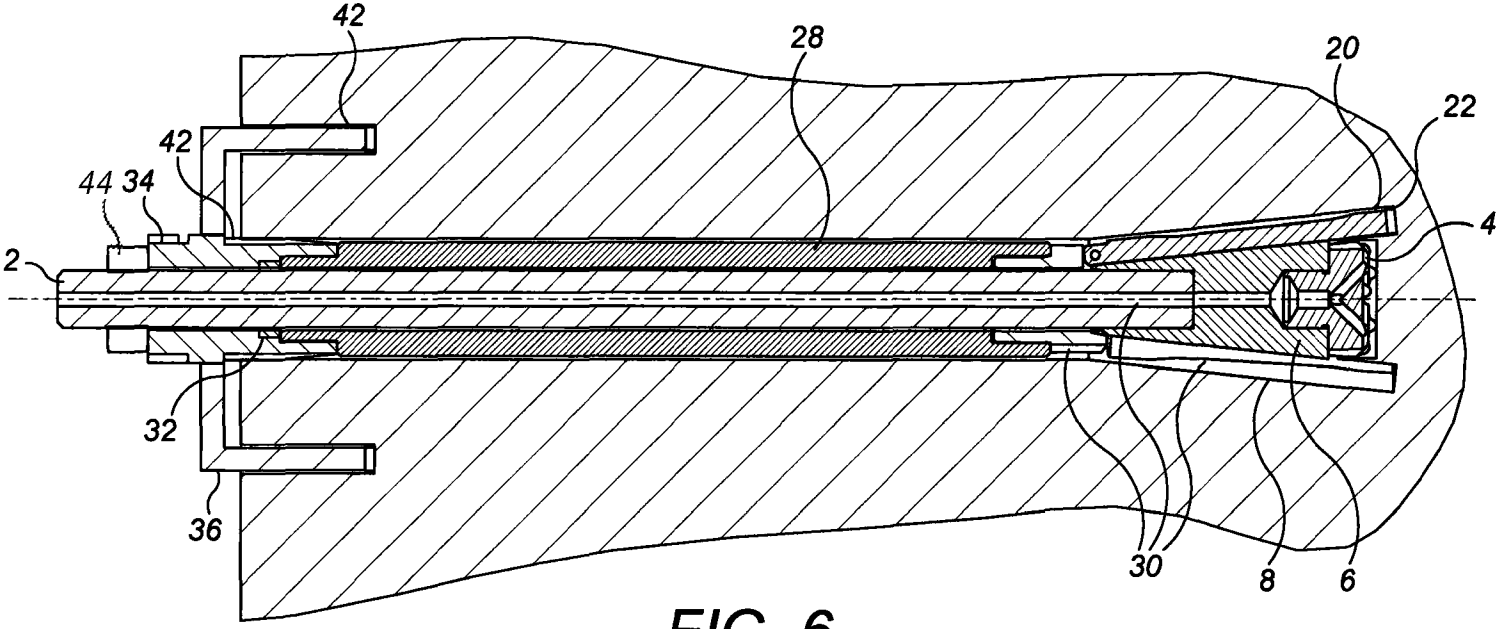

Illustrated in the drawings are two embodiments of fixation device showing a number of improvements to embodiments of anchor described in GB2513942. In particular, certain improvements enable an anchor to be used also as a pile, that is to say, making it capable of withstanding a load in compression. These include at least the provision of a means to apply a tensile load to the shaft serving as the anchor stem in situ in the form of a suitable tensioning mechanism.

The first embodiment includes a sleeve or outer casing arrangement and tensioning nut for this purpose. The second embodiment includes additional refinements to facilitate this pre-tensioning including a more extensive upper tapered formation on the sleeve or outer casing arrangement that drives into the upper part of the hole to resist the tensile load in conjunction with the anchor at the bottom of the hole, and a modification whereby the sleeve is made collapsible as an axial load is applied to the shaft.

The drawings show the sequence of events involved in installing a fixation device with such an anchor and pile function into a substrate.

Referring to FIGS. 1 to 6, an embodiment is shown encompassing some of the features of the anchor described in GB2513942 with certain modifications in accordance with the principles of the invention.

FIG. 1 illustrates the drilling of an initial guide hole. A pilot drill with drill stem is illustrated in isolation.

An elongate shaft 2 which will in due course serve as an anchor stem and pile tendon carries a first, pilot drill system including a drill head 6 mounted onto the distal end of the shaft with a first cutting tip at a most distal end in the form of a pilot drill bit 4. The drill head 6 comprises a body with a frustoconical surface. The drill bit 4 carries one or more first cutters to cut into the substrate, for example being a diamond impregnated cutter, a tungsten cutter, hardened steel cutter or a polycrystalline diamond cutter (PCD) or the like.

A suitable rotational drive is imparted to the shaft via a suitable torques linkage (not shown in FIG. 1) to rotatably drive the shaft about its longitudinal axis to effect a cutting action via the drill bit 4 and drive the shaft distally into the substrate. A guide hole 8 is thereby drilled into the substrate 1.

The anchor stem shaft 2 has a hollow central passage 10 communicating with channels 12 to provide a passage for a flushing solution to medium tom flush material away from the cutting surface of the drill bit 4.

FIGS. 2 to 6 illustrate the embodiment more completely showing its modification by provision of a sleeve in the form of an outer casing surrounding the anchor stem shaft 2 and associated components to effect first the drilling of a reverse tapered undercut into the bottom of the hole 8 and the deployment integrally with that step of an anchoring system into the reverse tapered undercut and second the fixing of the device at the substrate surface and the introduction of a pre-tension into the anchor stem shaft 2 to confer functionality as a pile tendon.

The sleeve casing in the illustrated embodiment has three principal components. At a distal end of the sleeve casing three outer casing articulating fingers 20 are provided, each carrying one or more second cutters 22 at a bottom end. Again, each cutter can be of any suitable material, for example being a diamond impregnated cutter, a tungsten cutter, a hardened steel cutter or a PCD cutter or the like. Each articulating finger is carried on an outer casing lower collar 24 by means of a pivot 26. The three articulating fingers 20 are distributed circumferentially about a bottom end of the outer casing lower collar on their respective pivots, and are thus enabled collectively to constitute a flareable end formation to the sleeve casing. An outer casing extension 28 extends upwardly out of the hole 8 and completes a sleeve casing structure embodying the principles of the invention.

FIGS. 2 to 6 illustrate the progressive deployment of the fixation mechanism in a second phase of deployment as the sleeve itself is driven downwards into the hole 8 and the articulating fingers 20 deploy and flare out over the frustoconical anchor drill head 6 which serves as a guide body, the taper of this guide body defining the outward flare of the articulating fingers and hence the reverse taper of the resultant undercut. In FIGS. 2 to 6, the sleeve casing and associated components are shown respectively first undeployed, then one quarter deployed, then half deployed, then three quarters deployed, then fully deployed, in each case in cross-section.

With reference to the drawings, in the second phase of deployment of the fixation mechanism when drilling a hole, the outer casing 28, 24, 20 is driven into the substrate so that the articulating fingers 20 project over the drill head 6 and ultimately beyond the drill bit 4. The drill head 6 on the shaft is tapered to flare outwardly towards the distal end of the shaft and thus acts as a guide body for the articulating fingers, which adopt a similar flare. The outer casing 28, 24, 20 is rotatably driven about the shaft, effecting a cutting action via the second cutters 22 at the tips of the articulating fingers 20 which cut "virgin" substrate (that is to say, substrate not cut into or disturbed by the first cutters of the drill bit 4) as the casing is driven distally relative to the shaft. This enables the second cutters 22 to make an undercut in the substrate 1 comprising a reverse taper cut into the substrate from the hole, wherein the angle of the taper corresponds generally to the angle of the flared surface of the drill head 6.

A surface securing arrangement comprising a top hat 36 with integrated collar is attached to the outer casing extension 28 at its proximal end. This has an inner collar which screws onto the outer casing extension 28. A bayonet drive 34 is attached to the collar using a bayonet fixing. The collar is tapered and fitted on its tapered surface with collar cutters which drill a tapered hole into the surface at the same time as the second, finger tip cutters 22 drill the undercut. The drill head taper and the collar taper in reverse directions co-operably resist the tensile load applied to the stem.

The central bore 10 of the shaft 2 and outer surface of the outer casing together define flushing channels 30, respectively for the pumping in and return to the surface of a flushing solution. A chevron seal 32 between the outer casing extension 28 and the collar prevents a flushing or washing medium, such as a liquid or air, which is pumped down into the hole through the anchor stem, from penetrating between the collar and the outer casing extension 28 on its way back to the surface.

The surface securing arrangement includes a "pile cap" or "top hat" attachment 36 comprising a laterally extending plate-like member and a cylindrical member. There are pile cap attachment cutters 40 on the open edge of the cylindrical member. Driving the collar also drives the pile cap or top hat attachment such that the pile cap attachment cutters 40 drill into the substrate at the same time as the collar cutters and finger tip cutters drill into the substrate. The cylindrical member extends distally into the annular groove that is cut. The pile cap attachment also takes compressive loads. In addition, the pile cap arrangement resists lateral loads imposed on the anchor. By extending distally into the substrate, the pile cap attachment assists in enabling the surface securing arrangement to withstand compressive loads. It also enables it to resist lateral loads. Moreover, the pile cap attachment may act as a platform or base on which a structure may stand.

By following a path underneath the top hat attachment via flushing channels 42, the chevron seal 32 preventing any escape, the flushing medium also washes cuttings away not only from around the drill bit, finger cutters and collar cutters, but also from around the pile cap attachment cutters.

The surface securing arrangement may dispense with the top hat arrangement.

A locking tensioning nut 44 is screwed onto a threaded upper portion of the anchor stem shaft 2.

In a third phase of deployment of the fixation device, once the fingers are fully engaged in the undercut, this is used to apply a pre-tension to the anchor stem shaft 10. The locking tensioning nut 44 is tightened tending to urge the anchor stem shaft 2 in a proximal direction back towards and out of the substrate surface. The fingers engaged in the undercut and the collar taper engaged at the top of the hole act in reverse directions co-operably to resist the tensile load applied to the anchor stem shaft 2. A tensile load can be generated in the anchor stem shaft in situ giving it functionality as a pile tendon and enabling the device as a whole better to resist the complex and variable load scenarios such as might be encountered when the device is used to fix a submerged structure to the sea bed for example.

Figure 7:
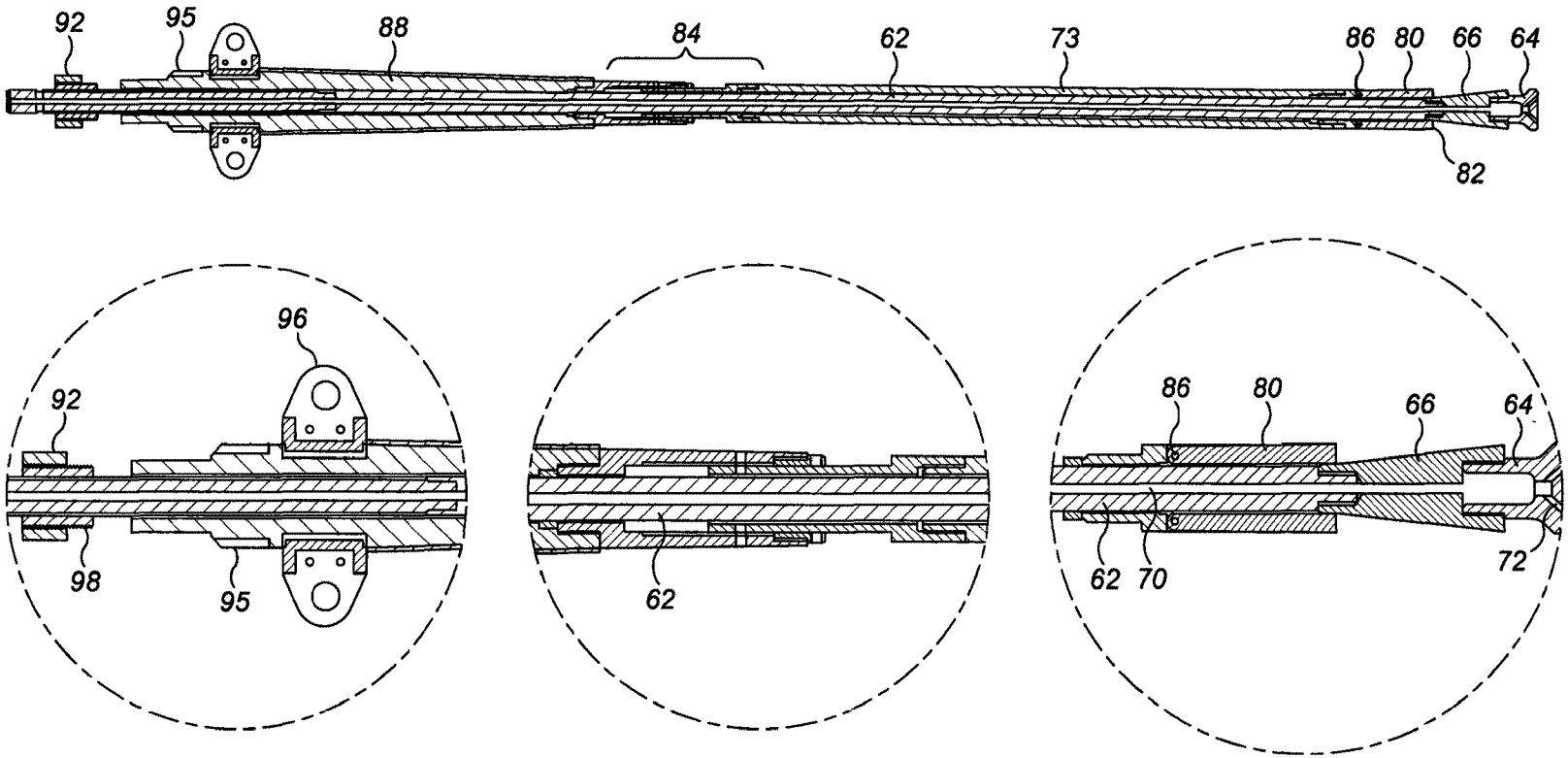
FIGS. 7 to 9 illustrate in cross-section at various stages of deployment into a ground substrate a second embodiment of fixation device in accordance with the principles of the invention.
Figure 8:
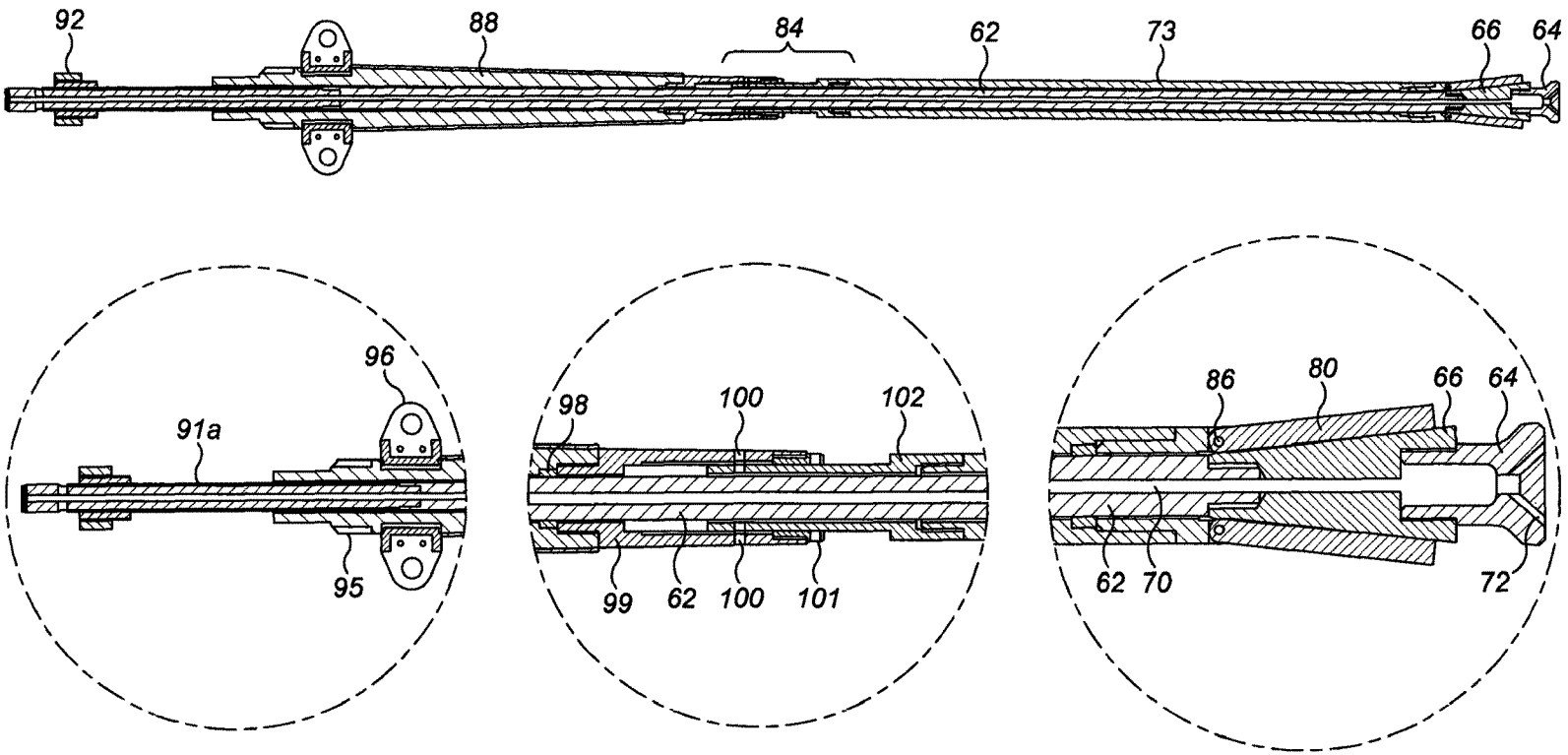
Figure 9:
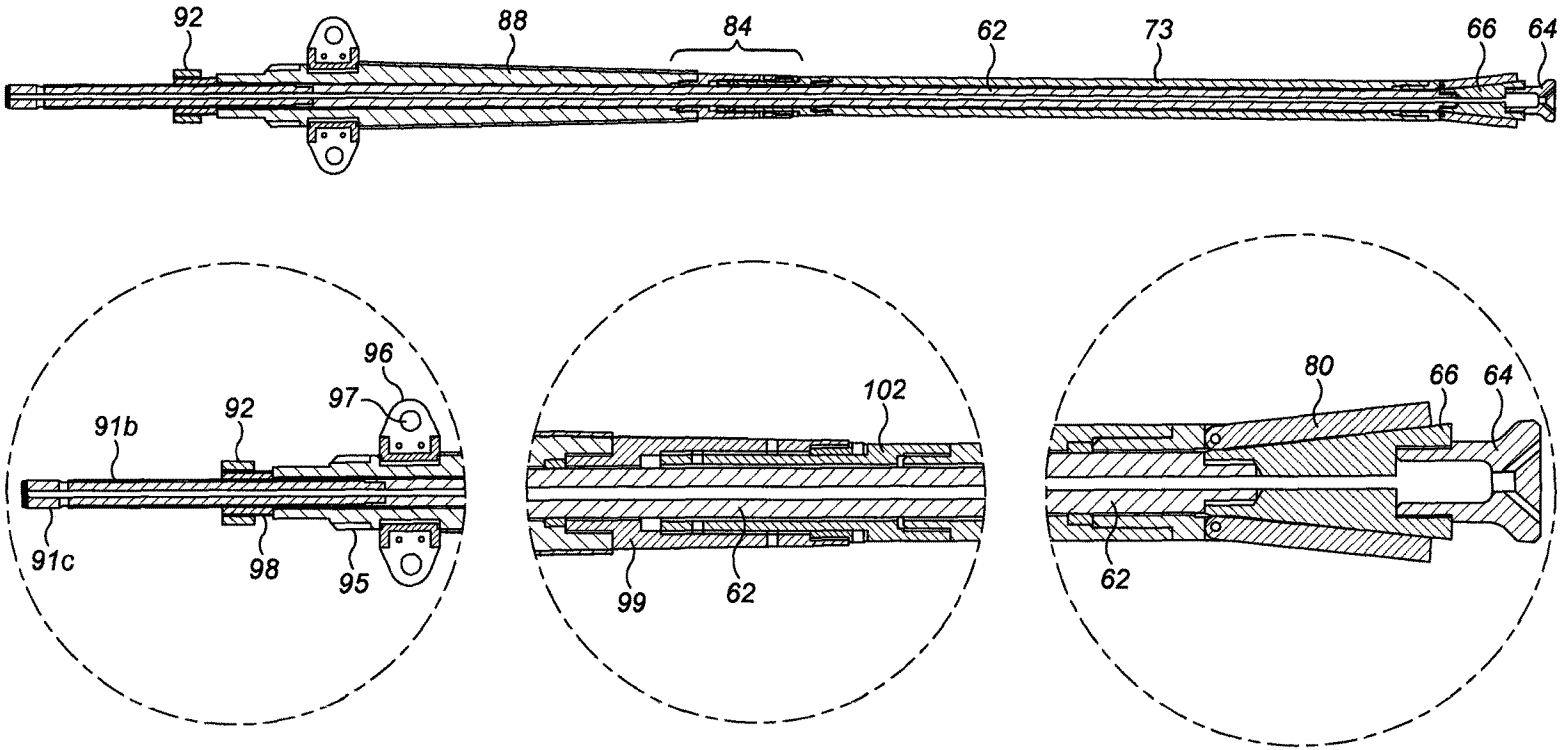

Referring to FIGS. 7 to 9, a further embodiment of fixation device is shown encompassing further features to facilitate pre-tensioning of the anchor stem shaft including a more extensive upper tapered formation on the sleeve or outer casing arrangement that drives into the upper part of the hole to resist the tensile load in conjunction with the anchor at the bottom of the hole, and a modification whereby the sleeve is made collapsible as an axial load is applied to the shaft.

FIGS. 7 to 9 again show the embodiment in progressively further stages of deployment. FIG. 7 shows the arrangement of the embodiment as it might be driven into a substrate and drill an initial hole in a first phase of deployment. FIG. 8 shows the arrangement after a second phase of the deployment where the articulating fingers have been driven into the substrate and drilled a reverse tapered undercut. FIG. 9 shows the configuration after sleeve has been collapsed following application of a pre-tension to the shaft in a third stage of deployment. In each case the fixation device is shown in cross-section, with exploded insets of each of three key positions representing the region of the rotary drive, the region of the frangible coupling collar, and the region of the drill bit. The substrate is not shown.

The embodiment of FIGS. 7 to 9 has a broadly similar general conformance as regards a central shaft with drill bit and outer casing with flareable distal portion as was illustrated in the embodiment of FIGS. 1 to 6. In particular, an elongate shaft 62 which will in due course serve as an anchor stem and pile tendon carries a first drill system including a drill bit 64 located at a most distal end and provided with one or more cutters to cut into the substrate. The shaft 62 again has a hollow central passage 70 communicating with channels 72 to provide a passage for a flushing medium to flush the cutting surface in the vicinity of the drill bit 64. A guide body 66 is provided in association with the shaft 62 behind the drill bit 64.

Surroundingly about the shaft 62 an outer casing or sleeve is provided. The casing or sleeve comprises a cylindrical lower casing part 73 provided at a distal end with cutting fingers 80 having second cutters 82 at a lower edge. The cutting fingers articulate about the lower part of the sleeve by means of pivots 86. The casing or sleeve further comprises an upper part 88, which is provided with a torque linkage to the lower part 73 by means of the breakable torque connection shown generally as 84 and in more detail in the middle of the three insets.

In a first phase of drilling a hole, a rotational drive is imparted to the shaft 62, either independently of the sleeve casing or in coupled manner in the sense that the entire arrangement is rotationally driven. This has the effect of rotatably driving the shaft about its longitudinal axis to effect a cutting action via the drill bit 64 and drive the device distally into the substrate through the hole thereby drilled in the substrate. An example drive for the shaft 62 is a hex drive.

In a second phase of deployment, the sleeve arrangement is rotatably decoupled from and driven separately from the shaft so that, in generally similar manner to the previous and prior art embodiments, the cutting fingers 80 effect the drilling of a reverse tapered undercut into the bottom of the hole and then serve integrally as an anchoring system engaging into the reverse taped undercut to fix the device therein.

This deployment is shown in particular by the illustration in FIG. 8. The fingers 80 are driven down and over the frustoconical guide body 66, causing the fingers 80 to pivot outwardly around the pivots 86, and to behave as a flareable end portion to the sleeve. The cutters 82 gouge out the undercut hole, and the fingers 80 seat within the resultant reverse tapered undercut and act as an anchor.

The fingers 80 have a graduated internal tapered profile so that when they are fully deployed over the tapered guide body the internal tapered profile exactly matches and engages a corresponding external graduated tapered profile of the guide body. This means that when the fingers are fully deployed the load is spaced evenly over the length of the fingers and guide body. This helps to prevent the fingers deforming under tensioning load. The feature therefore additionally facilitates the disengagement of the connection between the fingers and the guide body if removal of the anchor/pile device is required as described below.

The guide body 66 may be rigidly mounted on the shaft and for example form part of a drill head serving as a mounting for and rotating with the drill bit 64 as in the previous example.

Figure 10:
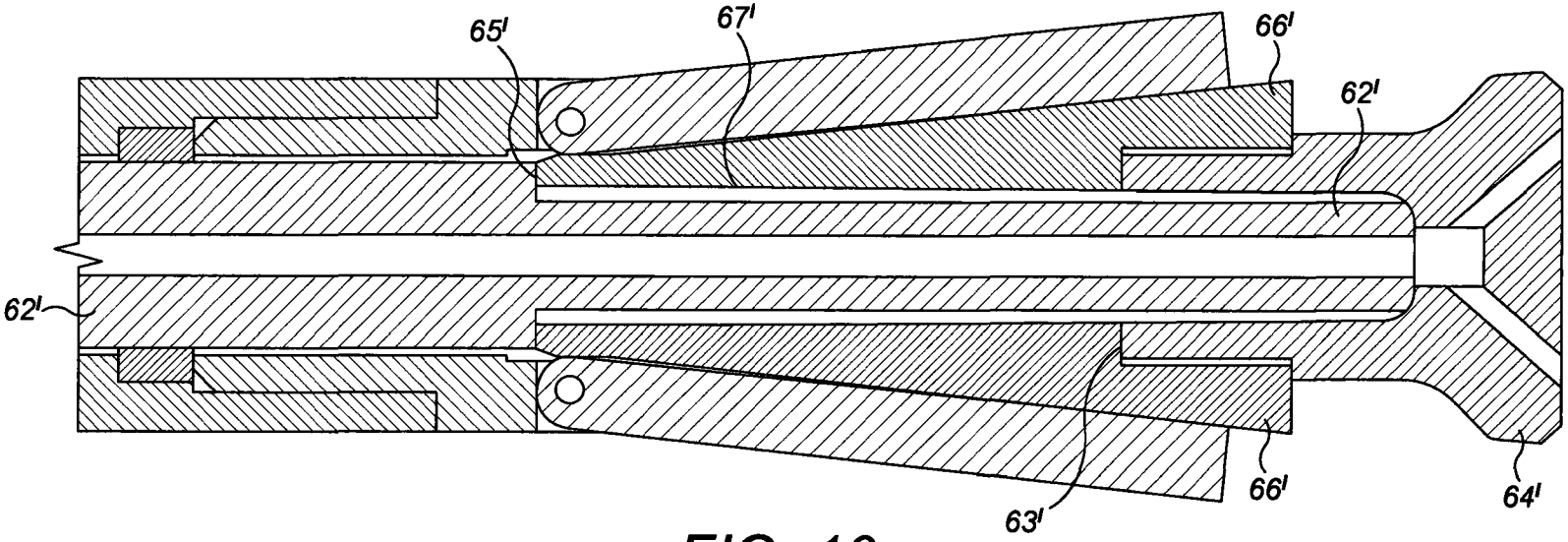
FIG. 10 illustrates a possible modification to the distal drill arrangement of FIGS. 7 to 9.

In an alternative modified embodiment illustrate in FIG. 10 the guide body 66' is separately formed from the inner shaft 62' and is mounted to be rotatable about the shaft but to have axial movement along the shaft restricted. The inner shaft 62' connects directly to the drill bit 64'. This will facilitate movement of the fingers over the tapered guide body when they are rotationally forming the undercut.

The guide body has a channel 67' defining an inner bearing surface journalled onto a distal portion of the shaft ahead of the drill bit 64'. The guide body has a stepped engagement 63' with the drill bit to prevent the drill bit from moving laterally back through channel in the guide body and a stepped engagement 65' to prevent axial movement in the other direction. The centre stem comprising the shaft and drill bit thus rotates independently of the guide body, but the tensile load can still be applied to the centre stem and transferred via the guide body and fingers to the substrate. At the same time as the fingers 80 are driven down and over the frustoconical guide body 66, the upper part 88 of the sleeve casing drives into the top of the hole. The upper part 88 is given a taper, for example in that it comprises a frustoconical body, in the opposite direction to the reverse taper defined by the fingers 80 in the deployed configuration. In a preferred case, the outer surface of the upper part 88 is provided with helical bladed cutters to facilitate the driving of this part into the top portion of hole in the vicinity of the surface.

During this second phase of deployment, the entire casing is driven rotatably by a suitable drive, in the embodiment a bayonet drive, through the drive coupling 95 with torque transmitted to the lower part and to the cutting fingers by means of the torque coupling 84.

Generally, a non-threaded drive is preferred for each of the outer sleeve and inner shaft. In a preferred case in the present embodiment a bayonet drive is provided for the outer sleeve and a hex drive for the inner shaft. This allows easy disengagement of the respective drives from the anchor/pile device without having to prevent rotational movement of either the inner shaft or outer sleeve as would be the case if the connections were threaded for example. The bayonet connection to the outer sleeve also facilitates easy connection for withdrawal of the anchor/pile device from the substrate after use as described below.

Once the fingers 80 are deployed into position within the reverse tapered undercut as an anchor, a pre-tensioning is introduced into the shaft to enable it to function as a pile tendon. This is done by means of the tensioning nut 92.

In the embodiment, tensioning is effected by further operation of the bayonet drive in a manner best illustrated with reference to the left hand inset in FIG. 9. The example drive comprises a threaded parallel bayonet drive which drives the device rotatably during the initial phase of deployment. An upper part of the shaft which is to become the tendon once pre-tensioned, 91*a*, 91*b*, projects beyond the drive with a threaded hex nut positioned upon it as a tensioning nut 92. A first portion of the projecting part of the shaft 91*a* has a thread in a first rotational sense and a second portion 91*b* has a thread in a rotational sense counter to the first. This works in conjunction with the collapsible torque linkage 84 during a third deployment phase in which the shaft in pre-tensioned.

The collapsible torque connection 84 is shown in more detail in the middle inset. It comprises an internally splined compression sleeve 99, an externally splined compression sleeve 102, and two shear pins 100 holding them together, in addition to retaining split rings 101 and spacer rings 98.

In the initial configuration shown in particular in FIG. 8, the coupling serves as a spacer part laterally the upper part 88 and lower part 73 of the sleeve and to transmit rotational drive between the two parts. In the third phase of deployment, as tension is progressively introduced into the shaft 62, a compressive load is generated across this linkage, and eventually the shear pins 100 fail at a predetermined compressive load, the two compression sleeves 99, 102 telescope one inside the other, and the axial spacing between the two parts 88 and 73 collapses.

The pre-tension in the shaft is then stabilised in admirably simple manner with the respective tapered and reversed tapered formations of the upper part 88 of the sleeve and of the deployed fingers 80 acting reactively in reverse directions co-operably to resist the tensile load in the anchor stem shaft 62, to stabilise the same, and to give functionality as a pile tendon. Optional disc springs 98 also play a role in maintaining the axial pre-tension.

A swivel cap 96 is provided in association with an upper end of the upper part 88 of the sleeve casing and/or shaft. When deployed in situ the tapered upper part 88 of the sleeve casing has been driven substantially into and seats stably within a correspondingly tapered top part of the hole in the vicinity of the surface of the substrate in which the device is retained. The swivel cap 96 sits above the surface and is mounted to be rotatable relative to the upper part 88 of the sleeve casing, for example having an internal bearing surface seated around an upper projection of the upper part of the shaft. Suitable connection formations such as the eyes 97 may be provided to provide a tethering site to secure chains, ropes, mooring lines etc for securing of structures to the anchored device, and for example in the preferred application submerged or floating structures. The swivel cap 96 allows movement of any such tether lines about the anchor.

It is a particular advantage of the illustrated embodiment that the device can readily arranged to be unloaded and removed. This may be effected by releasing the tensioning nut 92 and applying an axial load to the proximal end 91*c* of the inner shaft. This breaks the tape engagement at the distal end and releases the axial tension. The outer sleeve can then be withdrawn over the inner shaft allowing the fingers to collapse inwards. The preferred feature described above whereby the fingers have a graduated internal tapered profile that matches and engages a corresponding external graduated tapered profile of the guide body facilitates the ready disengagement of the fit between the fingers and the guide body.

As the outer sleeve is further withdrawn from the hole in the substrate it picks up the inner stem and the complete anchor/pile device is removed from the substrate.

The invention claimed is:

1. A fixation device comprising:

a shaft rotatable about a longitudinal axis with a first cutter at a first, distal end;

a guide body on the shaft shaped to taper outwardly towards the first end of the shaft;

an elongate sleeve disposed surroundingly about the shaft to be rotatable separately from the shaft and translatable in a longitudinal direction relative to the shaft;

a flareable end formation at a first, distal end of the elongate sleeve comprising one or more second cutters; and a tensioning mechanism associated with a second end of the sleeve, wherein:

the guide body and the flareable end formation are configured so that urging the sleeve towards the first end over the guide body flares the end formation outward from the shaft;

the tensioning mechanism is operable selectively to urge the shaft relative to the sleeve back towards the second end; and the sleeve is provided in two parts comprising a distal part and a proximal part, the two parts being axially spaced by a torque coupling by means of which they are co-rotatable as the sleeve is driven into the ground, but which torque coupling is adapted to allow relative translation of the two parts to reduce their axial spacing as an axial load is applied.

2. A fixation device in accordance with claim 1, wherein the tensioning mechanism is additionally configured to lock the shaft in a fixed mechanical relationship to the second end of the sleeve.

3. A fixation device in accordance with claim 1, wherein the tensioning mechanism further comprises a locking mechanism to lock the relative positions of the second end of the sleeve and the shaft at a selected relatively translated juxtaposition.

4. A fixation device in accordance with claim 1, wherein the tensioning mechanism is in either a direct mechanical association with or a fixed mechanical relationship to the second end of the sleeve.

5. A fixation device in accordance with claim 1, wherein:

a projecting proximal end portion of the shaft is configured to project beyond a proximal end of the sleeve through an aperture in the said proximal end, and a shaft engagement system is configured to engage the projecting end portion and apply a tensioning force to the same by urging the end portion in a direction beyond the proximal end of the sleeve outwardly of the aperture.

6. A fixation device in accordance with claim 1, wherein:

the tensioning mechanism includes a threaded formation; and a threaded portion on the shaft is provided and configured to engage with a complementary threaded formation provided in mechanical association with the second end of the sleeve.

7. A fixation device in accordance with claim 6, further comprising a tensioning nut disposed to engage in use upon a top bearing surface or cap of the second end of the sleeve whereby tightening of the tensioning nut tends to draw the shaft towards the second end of the fixation device.

8. A fixation device in accordance with claim 1, wherein:

a portion of the sleeve at or about a second end is provided in association with a reaction formation having one or more reaction surfaces adapted in use with the fixation device in situ in a substrate to engage with the substrate; and the reaction formation comprises an anchoring structure associated with a portion of the sleeve towards the second end.

9. A fixation device in accordance with claim 8, wherein the anchoring structure is configured integrally as part of the portion of the sleeve towards the second end.

10. A fixation device in accordance with claim 9, wherein the anchoring structure comprises a tapered formation of the sleeve towards the second end configured to taper outwardly towards the second end.

11. A fixation device in accordance with claim 10, wherein the tapered formation comprises one or more third cutters disposed on an outer surface.

12. A fixation device in accordance with claim 11, wherein the one or more third cutters comprise one or more helical blades.

13. A fixation device in accordance with claim 8, further comprising a surface securing arrangement comprising:

a formation in direct mechanical association with a portion of the sleeve at or about the second end and configured to be secured on or at the substrate surface;

a reaction surface disposed to seat upon the substrate surface in use; and an attachment comprising a laterally extending plate-like member and a cylindrical member.

14. A fixation device in accordance with claim 1, wherein:

the distal part and proximal part are axially spaced by a frangible torque coupling;

the frangible torque coupling comprises mutually engageable projecting torque surfaces at a distal end of the proximal part and a proximal end of the distal part engaged together by one or more frangible connectors such as one or more shear pins; and the frangible torque coupling is configured to fail at a predetermined axial loading as a pre-tensioning force is applied to the shaft by the tensioning mechanism.

15. A fixation device in accordance with claim 14, wherein the torque surfaces comprise mutually engageable internally and externally splined formations.

16. A fixation device in accordance with claim 1, wherein:

the shaft comprises a shaft drive coupling for applying torque to the shaft for driving the first cutter and the sleeve comprises a sleeve drive coupling for applying torque to the sleeve for driving the second cutters; and the drive couplings are bayonet drive couplings.

17. A fixation device in accordance with claim 1, wherein the guide body is a frustoconical body shaped to taper outwardly towards the first end of the shaft.

18. A fixation device in accordance with claim 1, wherein:

the flareable end portion of the sleeve comprises a pivot configured to allow the flareable end portion to bend about the pivot and thereby be flared outward; and the flareable end portion of the sleeve comprises a plurality of pivotable fingers.

19. A method of installing a fixation device into a substrate, the fixation device comprising a shaft rotatable about a longitudinal axis having a first cutter at a first, distal end; a guide body on the shaft shaped to taper outwardly towards the first end of the shaft; an elongate sleeve disposed surroundingly about the shaft to be rotatable separately from the shaft and translatable in a longitudinal direction relative to the shaft; and a flareable end formation at a first, distal end of the elongate sleeve comprising one or more second cutters, wherein the elongate sleeve is provided in two parts comprising a distal part and a proximal part axially spaced apart, the two parts are co-rotated as the sleeve is translated laterally, and the two parts are then caused to move axially closer together as the shaft is urged relative to the sleeve back towards the second end of the sleeve; the method comprising the steps of:

rotating the shaft and thereby boring a hole into a substrate using the first cutter;

translating the sleeve in a longitudinal direction distally relative to the shaft to urge the flareable end formation over the guide body and flare the end formation outward from the shaft;

rotating the sleeve and thereby reaming out an undercut in the substrate; and urging the shaft relative to the sleeve back towards the second end to apply a tension to the shaft.

20. The method in accordance with claim 19, wherein:

in a first phase of deployment the shaft is rotatably driven about its longitudinal axis to effect a cutting action via the first cutter and drive the first end of the shaft distally into the substrate;

in a second phase of deployment the flareable end portion of the sleeve is caused to move over the guide body positioned towards the distal end of the shaft behind the first cutter, such that when the flareable end portion of the sleeve reaches and passes over the guide body it is urged outwardly, the sleeve is rotatably driven about the shaft, effecting a cutting action via the second cutters and causing the sleeve to be driven distally relative to the shaft to make an undercut in the substrate; and in a third phase of deployment a pre-tension is applied to the shaft by urging the shaft relative to the sleeve back towards a second end of the device, being the end proximal to the substrate surface, whereby a tensile load is applied the shaft in situ.

21. The method in accordance with claim 19, comprising the further step of locking the relative positions of the second end of the sleeve and the shaft when a desired tension has been introduced into the shaft.

22. The method in accordance with claim 19, wherein a projecting proximal end portion of the shaft is arranged to project beyond a proximal end of the sleeve, for example through an aperture in the said proximal end, and the step of urging the shaft relative to the sleeve back towards the second end to apply a tension to the shaft comprises applying an urging force to the projecting proximal end portion.

23. The method in accordance with claim 19, wherein a threaded portion is provided on the shaft configured to engage with a complementary threaded formation provided in mechanical association with the second end of the sleeve and the step of applying a tension to the shaft comprises tightening the thread.

24. The method in accordance with claim 19, wherein an upper portion of the sleeve towards the second end comprises a tapered formation whereby the sleeve is configured to taper outwardly towards the second end with one or more third cutters disposed on an outer surface and the step of translating the sleeve in a longitudinal direction distally relative to the shaft includes driving this tapered formation into the substrate surface to form a complementarily tapered hole.

25. The method in accordance with claim 19, wherein the two parts are axially spaced by a frangible torque coupling and an axial load is applied to break this coupling.

* * * * *